United States Patent [19]

Brown

[11] Patent Number: 4,809,452

[45] Date of Patent: Mar. 7, 1989

[54] SHAPE MEMORY ALLOY ACTUATOR AND BUTTERFLY DEVICE

[75] Inventor: Wayne H. Brown, Irvine, Calif.

[73] Assignee: Naomitsu Tokieda, Tokyo, Japan

[21] Appl. No.: 122,252

[22] Filed: Nov. 17, 1987

[30] Foreign Application Priority Data

Nov. 17, 1986 [JP] Japan ..... 61-271728

[51] Int. Cl.[4] ..... G09F 19/08

[52] U.S. Cl. ..... 40/417; 40/411; 40/538

[58] Field of Search ..... 40/417, 411, 416, 419, 40/538, 466, 470

[56] References Cited

U.S. PATENT DOCUMENTS

| | | | |
|---|---|---|---|
| 1,652,775 | 12/1927 | Funk et al. | 40/417 |
| 2,704,908 | 3/1955 | Lamkin | 40/417 |
| 2,770,818 | 11/1956 | Polk | 40/417 |
| 2,846,799 | 8/1958 | Polk | 40/417 |
| 2,860,434 | 11/1958 | Kost et al. | 40/417 |
| 3,153,871 | 10/1964 | Semba | 40/417 |
| 3,487,569 | 1/1970 | Mendall | 40/538 |
| 3,964,189 | 5/1976 | Belokin | 40/538 |
| 4,578,888 | 4/1986 | Gomez | 40/411 |

*Primary Examiner*—Gene Mancene
*Assistant Examiner*—W. Contreras
*Attorney, Agent, or Firm*—Birch, Stewart, Kolasch & Birch

[57] ABSTRACT

A shape memory alloy actuator for rotating a pair of rotary members simultaneously and symmetrically like a butterfly moves its wings. The two rotary members are rotatably connected to each other at each one end portion thereof and biased in rotating directions opposite to each other by a biasing device. A wire-shaped shape memory alloy extending in a direction intersecting the rotary plane of the rotary members and fixed at opposite end portions thereof are associated at the intermediate portion thereof with a connected portion between the rotary members. When heated, the alloy shrinks attempting to return to the original length it remembers, and pushes the connected portion to rotate the rotary members against the biasing device. When cooled, the alloy, being stretched, allows the rotary members to be rotated back to their initial positions by the biasing device. A butterfly device involving the actuator is also disclosed.

17 Claims, 6 Drawing Sheets

SHAPE MEMORY ALLOY ACTUATOR AND BUTTERFLY DEVICE

BACKGROUND OF THE INVENTION

1. Field of the Invention

This invention relates to actuators having a shape memory alloy as a driving source, and more particularly to a shape memory alloy actuator for rotating a pair of rotary members simultaneously and symmetrically in such a manner that a butterfly moves its right and left wings, as well as to a butterfly device having such an actuator.

2. Prior Art

In the prior art any attempt to construct an actuator which performs the aforesaid function brought forth such disadvantages as the actuator being complicated in construction to a considerable extent, large in size, heavy in weight and high in manufacturing cost.

SUMMARY OF THE INVENTION

Accordingly, it is an object of the present invention to provide a shape memory alloy actuator which, utilizing a shape memory alloy as a driving source, rotates a pair of rotary members simultaneously and symmetrically in such a manner that a butterfly moves its right and left wings.

Another object of the present invention is to provide such a shape memory alloy actuator which is simplified in construction.

Another object of the present invention is to provide such a shape memory alloy actuator which can reduce manufacturing costs to a considerable extent.

Another object of the present invention is to provide such a shape memory alloy actuator which is compact in size.

Still another object of the present invention is to provide such a shape memory alloy actuator which is light weight.

Still another object of the present invention is to provide such a shape memory alloy actuator out of which high torque can be extracted in a wide range of rotary angles of the rotary members during both a deformation process (cooling process) and a shape recovery process (heating process) of the shape memory alloy, thus achieving a very high efficiency.

A further object of the present invention is to provide a butterfly device which, utilizing such a shape memory alloy actuator, moves its right and left wings simultaneously and symmetrically in the same manner that a live butterfly does.

In accordance with the above objects, the present invention in a shape memory alloy actuator and butterfly device includes first and second rotary members connected to each other at each one end portion thereof. Support members support the first and second rotary members in a state where the rotary members are mutually rotatable. A wire-shaped shape memory alloy is provided substantially extending in a direction intersecting the rotating plane of the first and second rotary members. The shape memory alloy is fixed at opposite end portions thereof at least with regard to the tensile direction and associated at the intermediate portion thereof with a connected portion between the first and second rotary members. Biasing means biases the first and second rotary members in rotating directions opposite to each other.

According to the present invention, when the shape memory alloy is not heated, an angle between the first and second rotary members forms a predetermined initial angle through the biasing forces of the biasing means. At this time, the shape memory alloy has a stretched length longer than the original length it remembers. However, when the shape memory alloy is heated to an appropriate temperature, the alloy shrinks attempting to return to the original length by the shape memory effect, whereby the alloy applies a force to the connected portion between the first and second rotary members, so that the first and second rotary members rotate simultaneously and symmetrically. Subsequently, when heating of the shape memory alloy is stopped, the alloy loses the shape recovering force, whereby the first and second rotary members return again to the positions where the rotary members form the initial angle through the biasing forces of the biasing means and the shape memory alloy returns to the stretched length longer than the original length.

BRIEF DESCRIPTION OF THE DRAWINGS

The foregoing and other objects, features and advantages of the present invention will become apparent from the following detailed description when taken in connection with the accompanying drawings. It is to be understood that the drawings are designed for the purpose of illustration only and are not intended as a definition of the limits of the invention.

DESCRIPTION OF THE PREFERRED EMBODIMENTS

Figure 1:
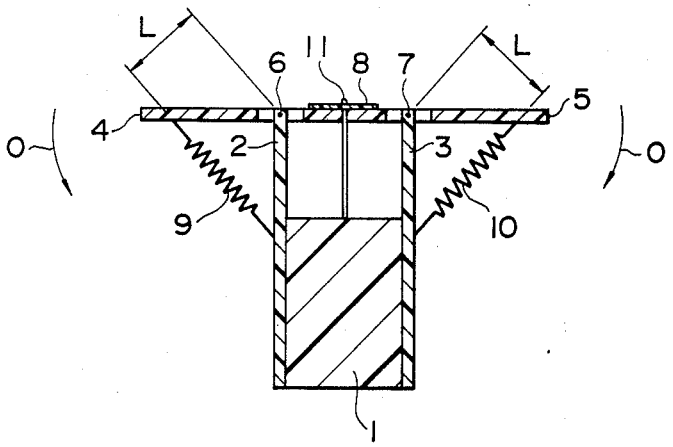
FIG. 1 is a sectional view showing a first preferred embodiment of the shape memory alloy actuator according to the present invention in a state where the rotary members are fully opened (The position of section is the line I—I in FIG. 3)

Preferred embodiments of the present invention will now be described hereunder with reference to the accompanying drawings.

A first preferred embodiment of the present invention will be shown in FIGS. 1 to 5. In this embodiment, support members 2 and 3 each formed of a plastic strip with relatively highly elasticity are secured to opposite side portions of a base 1 with upper end portions thereof projected upwardly from the base 1. The intermediate portions of first and second rotary members 4 and 5 are rotatably supported at the upper end portions of the support members 2 and 3 through rotary shafts 6 and 7, respectively. Here, the rotary members 4 and 5 are subject to restriction by the support members 2, 3 in the ranges of rotation thereof relative to the support members, so that, in the opening directions (directions indicated by arrows 0 in FIG. 1) the rotary members 4 and 5 can rotate only to positions shown in FIG. 1, i.e. positions where the rotary members 4 and 5 make right angles with the support members 2 and 3.

Figure 2:
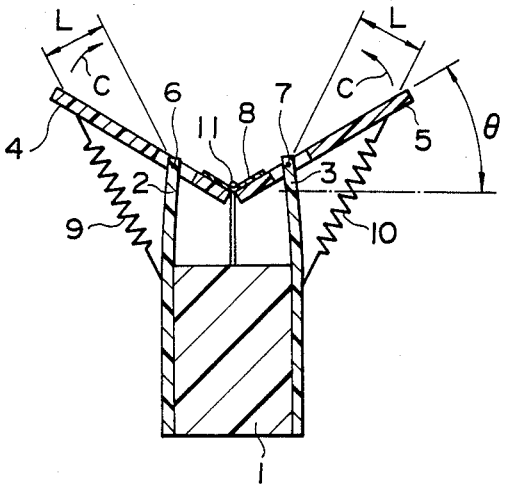
FIG. 2 is a sectional view showing the first preferred embodiment in a state where the rotary members are closed to some degree (The position of section is the line II—II in FIG. 4)

End portions on one side of the first and second rotary members 4 and 5 are rotatably connected to each other through a tape material 8 which is adhesively applied to over these two end portions. Here, the support members 2 and 3 are formed of a relatively highly elastic material as described above, whereby, when the first and second rotary members 4 and 5 are rotated, the support members 2 and 3 flex as shown in FIG. 2, so that supporting of the rotary members 4 and 5 by the support members 2 and 3 does not interfere the rotations of the rotary members 4 and 5 relative to each other.

Stretched across the forward end of the first rotary member 4 and the base 1, and across the forward end of the second rotary member 5 and the base 1 are tensile coil springs 9 and 10, respectively, whereby the coil springs 9 and 10 bias the rotary members 4 and 5 in the opening directions (directions indicated by the arrows O in FIG. 1).

Figure 3:
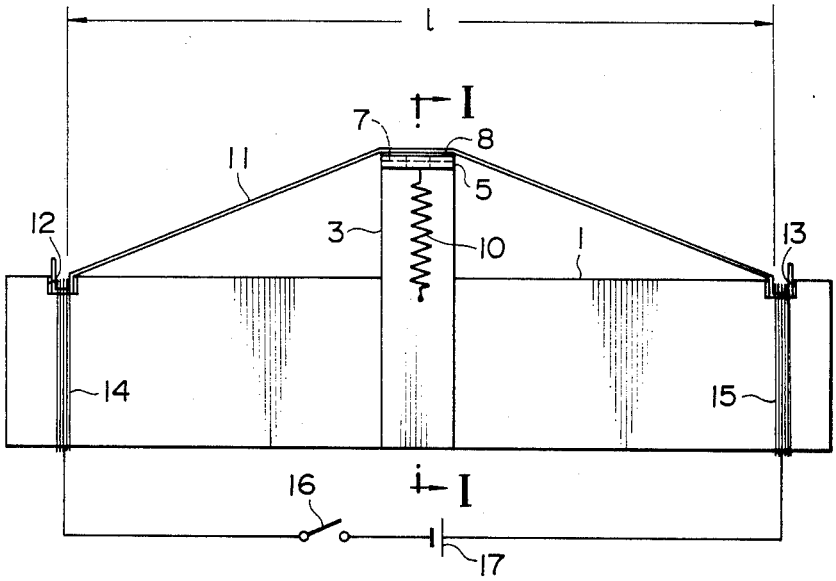
FIG. 3 is a side view showing the first preferred embodiment in a state where the rotary members are fully opened.
Figure 4:
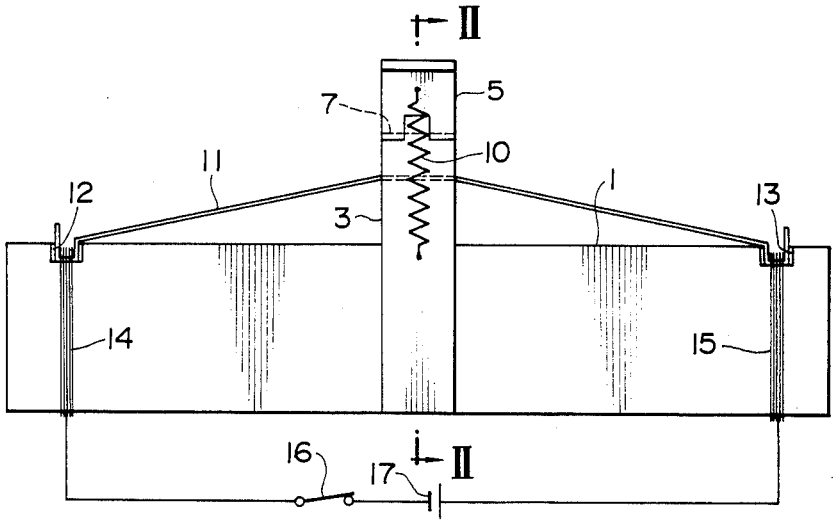
FIG. 4 is a side view showing the first preferred embodiment in a state where the rotary members are closed to some degree.
Figure 5:
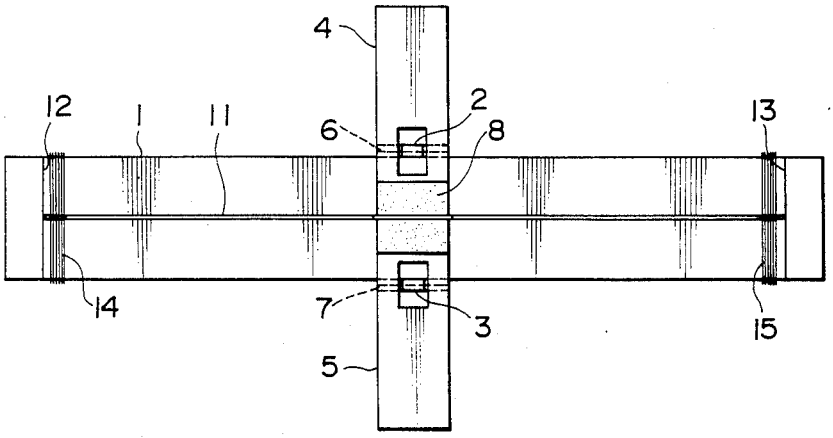
FIG. 5 is a plan view showing the first preferred embodiment in a state where the rotary members are fully opened.

The longitudinal direction of the base 1 extends in directions perpendicularly intersecting the rotating plane of the rotary members 4 and 5. As shown in FIGS. 3 and 4, opposite end portions of a wire-shaped shape memory alloy 11 made of a Ti—Ni alloy are fixed to positions close to opposite end portions of the base 1 in the longitudinal direction thereof.

In this embodiment, the opposite end portions of the shape memory alloy 11 are received in grooves 12 and 13 formed at positions close to the opposite end portions of the base 1 and tied to the base 1 by conductors 14 and 15 to be fixed thereby. However, according to the present invention, the method of fixing the opposite ends of the shape memory alloy need not necessarily be limited to the method indicated in this embodiment. Furthermore, the shape memory alloy 11 may be fixed at least with regard to the tensile direction.

Furthermore, in this embodiment, the original length remembered by a section of the shape memory alloy 11 between the fixed portions is equal to or somewhat shorter than a distance 1 between the fixed portions.

The intermediate portion of the shape memory alloy 11 is in abutting contact with the connected portion between the rotary members 4 and 5. The opposite end portions of the shape memory alloy 11 are connected to a power source 17 through the conductors 14, 15 and a switch 16.

Operation of this preferred embodiment is substantially as follows.

When the switch 16 is opened and the shape memory alloy 11 is at ambient temperature or room temperature, the first and second rotary members 4 and 5 are opened horizontally in the drawings through the resiliency of the springs 9 and 10 as shown in FIGS. 1 and 3. At this time, the shape memory alloy 11 has a stretched length longer than the original length it remembers and is bent to some degree at a portion thereof which is abutted against the connected portion between the rotary members 4 and 5 as shown in FIG. 3.

However, when the switch 16 is closed, an electric current is passed from the power source 17 to the shape memory alloy 11 through the switch 16, and the conductors 14 and 15, whereby the alloy 11 is heated by the Joule heat, shrinks attempting to return to the original length it remembers by the shape memory effect, and pushes down the connected portion between the rotary members 4 and 5 as shown in FIGS. 2 and 4, so that the rotary members 4 and 5 rotate in the closing directions (directions indicated by arrows C in FIG. 2). At this time, in this embodiment, the support members 2 and 3 are elastically deformed to some degree.

When the switch 16 is opened again and current passage to the shape memory alloy 11 is stopped, the alloy 11 loses the shape recovering force, whereby the rotary members 4 and 5 come to be opened horizontally again in the drawings as shown in FIGS. 1 and 3, and the alloy comes to have the stretched length longer than the original length.

Figure 6:
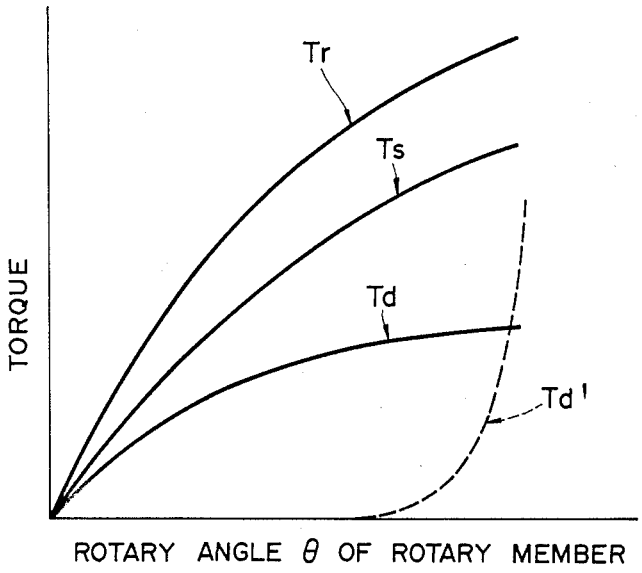
FIG. 6 is a characteristic curve diagram showing the relationships of the rotary angle $\theta$ of each of the rotary members with a torque generated by the shape memory alloy during shape recovering, with a bias torque by the springs and with a torque by a resisting force the shape memory alloy gives when deformed at ambient temperature in the first preferred embodiment.

A curve $T_r$ in FIG. 6 shows the relationship between the rotary angle $\theta$ of each of the rotary members 4 and 5 and the torque generated by the shape memory alloy 11 during shape recovering. In general, the larger the deformation received by the shape memory alloy is, the larger the shape recovering force from the deformation becomes, so that the larger the angle $\theta$ is, so becomes the torque indicated by this curve $T_r$.

A curve $T_s$ in FIG. 6 shows the relationship between the rotary angle $\theta$ and the bias torque by the springs 9 and 10. As apparent from FIGS. 1 and 2, in this device, the smaller the rotary angle $\theta$ of each of the rotary members 4 and 5 is, the smaller the distances L between the lines of action of the springs 9 and 10 and the rotary shafts 6 and 7 becomes, so that, as the curve $T_s$ shows, the smaller the rotary angle $\theta$ is, the smaller the bias torque by the springs 9 and 10 becomes.

Further, a curve $T_d$ shows the relationship between the rotary angle $\theta$ and the torque by the resisting force the shape memory alloy gives when deformed at ambient temperature (incidentally, in the case of some shape memory alloys such as well-trained shape memory alloys, etc., the torque by the aforesaid resisting force is indicated by a curve $T_d'$ but not by the curve $T_d$).

Here, a torque which can be extracted out of the actuator during the shape recovery process (heating process) of the shape memory alloy 11 is a difference between the curves $T_r$ and $T_s$, and a force which can be extracted out of the actuator during the deformation process (cooling process) of the shape memory alloy 11 is a difference between the curves $T_s$ and $T_d$ (or $T_d'$), so that, in this device, a large torque can be extracted in the rotary angle $\theta$ of a wide range during both te shape recovery process and the deformation process of the shape memory alloy 11, thus enabling a very high efficiency.

FIGS. 7 to 11 show a second preferred embodiment of the present invention.

In this preferred embodiment, similarly to the preceding embodiment, support members 22 and 23 formed of plastic strip are secured to a base 21 with upper end portions thereof projected from the base 21. Designated at 24 is a first rotary member and at 25 a second rotary member. Rubber materials 29 and 30, which are made of silicone rubber or the like, are applied over the intermediate portions of the rotary members 24 and 25, and the upper end portions of support members 22 and 23, respectively. With this arrangement, the rotary members 24 and 25 are rotatably supported by the support members 22 and 23 through the rubber materials 29 and 30, respectively. The rubber materials 29 and 30 bias the rotary members 24 and 25 in the opening directions (directions indicated by arrows O in FIG. 7).

End portions on one side of the first and second rotary members 24 and 25 are rotatably connected to each other through a tape material 28, which is adhesively applied over these two end portions. Here, in this preferred embodiment, the rotary members 24 and 25 are rotatably supported by the support members 22 and 23 through the rubber materials 29 and 30, so that, even if the support members 22 and 23 are nt elastic, supporting of the rotary members 24 and 25 by the support members 22 and 23 does not interfere with the rotations of the rotary members 24 and 25 relative to each other. However, needless to say, the support members 22 and 23 may be elastic.

In this embodiment also, opposite end portions of a wire-shaped shape memory alloy 31 made of a Ti—Ni alloy are fixed to portions close to opposite end portions of the base 21 in the longitudinal direction thereof. Denoted at 32 and 33 are grooves similar to those 12 and 13 shown in the preceding preferred embodiment. Denoted at 34 and 35 are conductors similar to those 14 and 15 shown in the preceding preferred embodiment. Furthermore, similarly to the case of the preceding embodiment, the original length remembered by a section of the shape memory alloy 31 between the fixed portions is equal to or somewhat shorter than the distance 1 between the fixed portions. The intermediate portion of the shape memory alloy 31 is in abutting contact with the connected portion between the rotary members 24 and 25. The opposite end portions of the shape memory alloy 31 are connected to a power source 37 through the conductors 34 and 35 and a switch 36.

Figure 7:
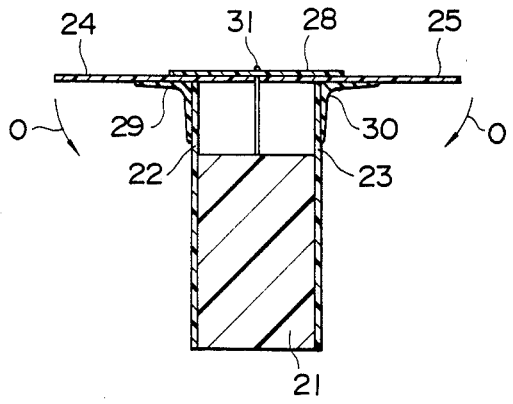
FIG. 7 is a sectional view showing a second preferred embodiment of the present invention in a state where the rotary members are fully opened (The position of section is the line VII—VII in FIG. 9)
Figure 9:
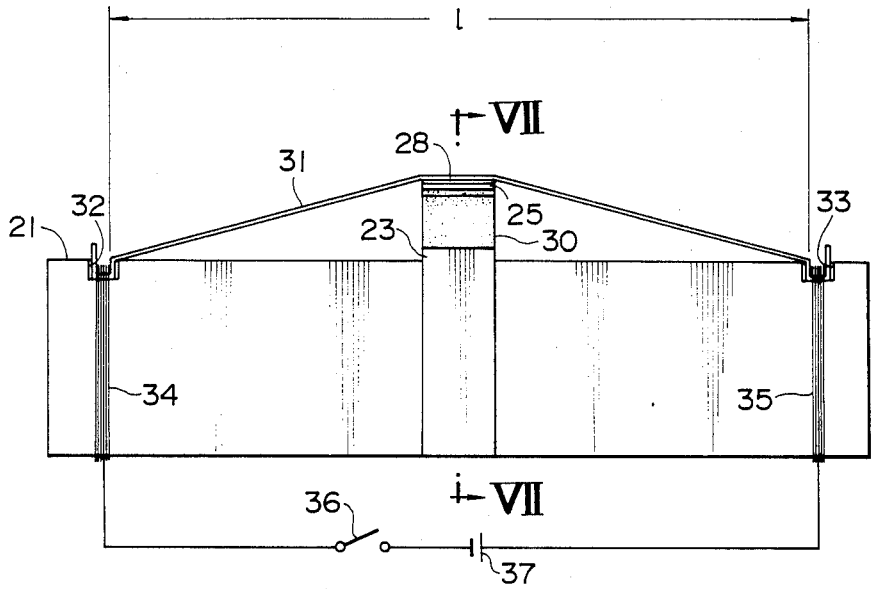
FIG. 9 is a side view showing the second preferred embodiment in a state where the rotary members are fully opened.

In this embodiment also, when the switch 36 is opened and the shape memory alloy 31 is at ambient temperature, the first and second rotary members 24 and 25 are opened horizontally in the drawings through the elasticity of the rubber materials 29 and 30 as shown in FIGS. 7 and 9. At this time, the shape memory alloy 31 has a stretched length longer than the original length it remembers and is bent to some degree at a portion thereof which is abutted against the connected portion between the rotary members 24 and 25 as shown in FIG. 9.

Figure 8:
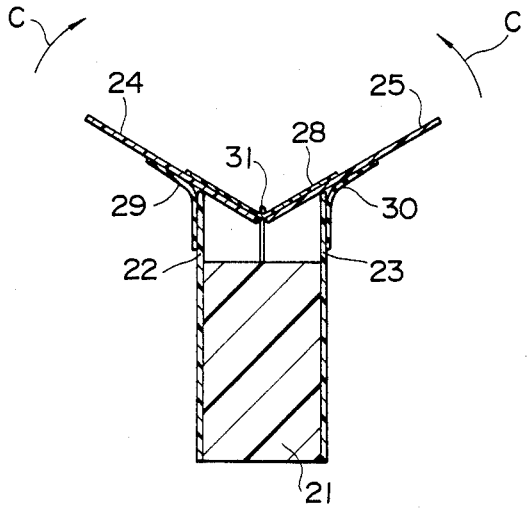
FIG. 8 is a sectional view showing the second preferred embodiment in a state where the rotary members are closed to some degree (The position of section is the line VIII—VIII in FIG. 10)
Figure 10:
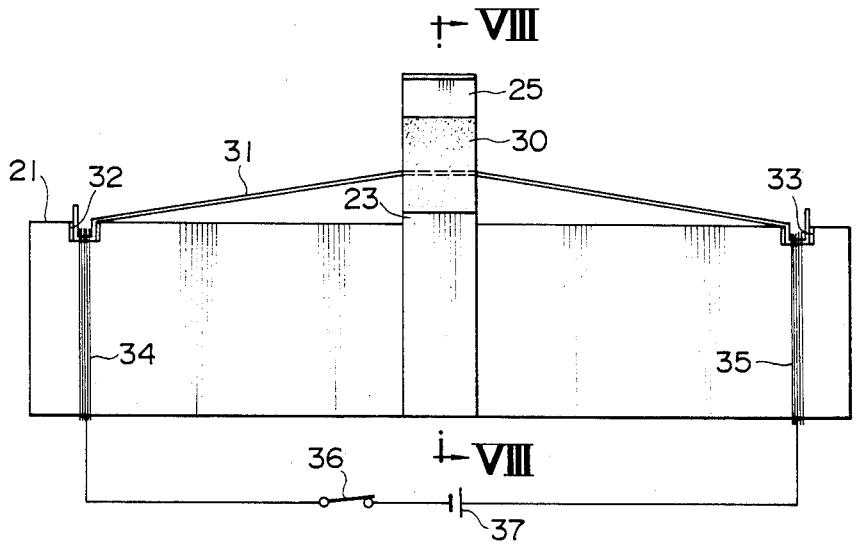
FIG. 10 is a side view showing the second preferred embodiment in a state where the rotary members are closed to some degree.

However, when the switch 36 is closed, an electric current is passed from the power source 37 to the shape memory alloy 31 through the switch 36, and the conductors 34 and 35, whereby the alloy 31 is heated by the Joule heat, shrinks attempting to return to the original length, and pushes down the connected portion between the rotary members 24 and 25 as shown in FIGS. 8 and 10, so that the rotary members 24 and 25 rotate in the closing directions (directions indicated by arrows C in FIG. 8).

When the switch 36 is opened again and current passage to the shape memory alloy 31 is stopped, the alloy 31 loses the shape recovering force, whereby the rotary members 24 and 25 come to be opened horizontally again in the drawing through the elasticity of the rubber materials 29 and 30 as shown in FIG. 7 and the alloy 31 comes to have the stretched length longer than the original length it remembers.

The relationships of the rotary angle $\theta$ of each of the rotary members 24 and 25 with the torque generated by the shape memory alloy 31 during its shape recovering, with the bias torque by the rubber materials 29 and 30, and with the torque by the resisting force the shape memory alloy 31 gives when deformed at ambient temperature are similar to those in the case of the preceding embodiment; i.e. these relationships are similar to those shown in FIG. 6.

Figure 11:
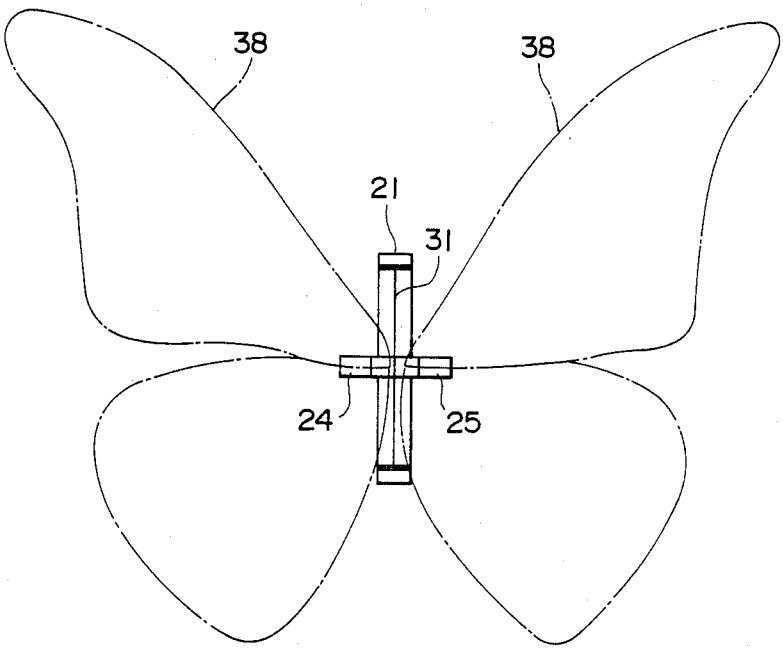
FIG. 11 is a plan view showing one embodiment of the butterfly device according to the present invention with wings of a butterfly secured to the shape memory alloy actuator of the second preferred embodiment.

FIG. 11 shows one preferred embodiment of the butterfly device of the present invention. In this device wings 38 of a genuine butterfly are secured to the rotary members 24 and 25 of the second embodiment of shape memory actuator, respectively. With this arrangement it may seem as if a live butterfly were opening and closing the wings 38 when the rotary members 24 and 25 are opened and closed as described above. Therefore, this butterfly device can be utilized, for example, as an exhibit device.

Instead of the natural butterfly wings 38, artificial butterfly wings such as those made out of paper, thin plastics, or the like may be used.

In the above preferred embodiments, Ti—Ni alloy is used as the shape memory alloy, however, in the present invention, shape memory alloys other than the abovementioned alloy may be used.

Furthermore, in the present invention, the means for biasing the rotary members need not necessarily be limited to those having constructions shown in the above preferred embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A shape memory alloy actuator comprising:

first and second rotary members connected to each other at each one end portion thereof;

support members for supporting said first and second rotary members in a state where said rotary members are mutually rotatable;

biasing means for biasing said first and second rotary members in rotating directions opposite to each other; and a wire-shaped shape memory alloy substantially extending in a direction intersecting the rotating plane of said first and second rotary members, fixed at opposite ends thereof at least with regard to the tensile direction, and associated at the intermediate portion thereof with a connected portion between said first and second rotary members, when said alloy shrinks attempting to return to the original length it remembers, said first and second rotary members being rotated in directions opposite to the biasing directions of said biasing means against said biasing means.

2. A shape memory alloy actuator as recited in claim 1, wherein said first and second rotary members are rotatably connected to each other at each one end portion thereof by a tape material adhesively applied over said end portions of said first and second rotary members.

3. A shape memory alloy actuator as recited in claim 1, wherein said support members are each made of a material elastically deformable in accordance with rotations of said first and second rotary members.

4. A shape memory alloy actuator as recited in claim 1, wherein said biasing means are springs.

5. A shape memory alloy actuator as recited in claim 1, wherein said biasing means are rubber materials.

6. A shape memory alloy actuator as recited in claim 5, wherein said rubber materials are applied partly over said first rotary member and one of said support members, and partly over said second rotary member and the other of said support members, respectively.

7. A shape memory alloy actuator as recited in claim 1, wherein said shape memory alloy is made of a Ti—Ni alloy.

8. A butterfly device comprising:

first and second rotary members connected to each other at each one end portion thereof;

support members for supporting said first and second rotary members in a state where said rotary members are mutually rotatable;

biasing means for biasing said first and second rotary members in rotating directions opposite to each other;

a wire-shaped shape memory alloy substantially extending in a direction intersecting the rotating plane of said first and second rotary members, fixed at opposite ends thereof at least with regard to the tensile direction, and associated at the intermediate portion thereof with a connected portion between said first and second rotary members, when said alloy shrinks attempting to return to the original length it remembers, said first and second rotary members being rotated in directions opposite to the biasing directions of said biasing means against said biasing means; and wings of a butterfly symmetrically secured to said first and second rotary members, respectively.

9. A butterfly device as recited in claim 8, wherein said first and second rotary members are rotatably connected at end portions on one side to each other by a tape material adhesively applied over said end portions of said first and second rotary members.

10. A butterfly device as recited in claim 8, wherein said support members are each made of a material elastically deformable in accordance with rotations of said first and second rotary members.

11. A butterfly device as recited in claim 8, wherein said biasing means are springs.

12. A butterfly device as recited in claim 8, wherein said biasing means are rubber materials.

13. A butterfly device as recited in claim 12, wherein said rubber materials are applied partly over said first rotary member and one of said support members, and partly over said second rotary member and the other of said support members, respectively.

14. A butterfly device as recited in claim 8, wherein said shape memory alloy is made of a Ti—Ni alloy.

15. A butterfly device as recited in claim 8, wherein said wings of the butterfly are natural.

16. A butterfly device as recited in claim 8, wherein said wings of the butterfly are artificial.

17. A butterfly device as recited in claim 8, further comprising means for passing an electric current to said shape memory alloy.

* * * * *